US007077252B2

(12) United States Patent
Sanchez

(10) Patent No.: US 7,077,252 B2
(45) Date of Patent: Jul. 18, 2006

(54) COMBINATION GOLF BAG TRAVEL COVER AND SUITCASE

(76) Inventor: Ricardo Sanchez, 9859 Orange Park Trail, Boca Raton, FL (US) 33428

( * ) Notice: Subject to any disclaimer, the term of this patent is extended or adjusted under 35 U.S.C. 154(b) by 0 days.

(21) Appl. No.: 10/957,054

(22) Filed: Oct. 1, 2004

(65) Prior Publication Data

US 2005/0072642 A1 Apr. 7, 2005

Related U.S. Application Data

(60) Provisional application No. 60/508,434, filed on Oct. 3, 2003.

(51) Int. Cl.

| | |
|---|---|
| ***A45C 5/00*** | (2006.01) |
| ***A45C 5/14*** | (2006.01) |
| ***A45C 13/38*** | (2006.01) |
| ***A63B 55/00*** | (2006.01) |
| ***A63B 57/00*** | (2006.01) |

(52) U.S. Cl. ..... 190/108; 190/18 A; 190/110; 150/159; 206/315.3; 206/315.4

(58) Field of Classification Search ..... 206/315.4, 206/315.3; 190/18 A, 108, 110; 280/DIG. 6; 150/159

See application file for complete search history.

(56) References Cited

U.S. PATENT DOCUMENTS

| | | | | |
|---|---|---|---|---|
| 4,951,818 | A * | 8/1990 | Johnson | 206/315.1 |
| 5,927,361 | A * | 7/1999 | Sanderson et al. | 150/159 |
| 5,975,170 | A * | 11/1999 | Anguiano | 150/159 |
| 6,161,698 | A * | 12/2000 | Bradshaw et al. | 206/527 |
| 6,164,425 | A * | 12/2000 | Latshaw | 190/18 A |
| 6,315,115 | B1 * | 11/2001 | Bradshaw et al. | 206/315.4 |
| 6,330,944 | B1 * | 12/2001 | DeMichele | 206/315.3 |
| 6,401,890 | B1 * | 6/2002 | Tan | 190/107 |
| 6,557,702 | B1 * | 5/2003 | Sanderson et al. | 206/315.4 |
| 2003/0029750 | A1 * | 2/2003 | Boardman et al. | 206/315.4 |
| 2003/0029751 | A1 * | 2/2003 | Boardman et al. | 206/315.4 |

* cited by examiner

*Primary Examiner*—Sue A. Weaver
(74) *Attorney, Agent, or Firm*—Robert M. Downey, PA

(57) ABSTRACT

A travel cover for a golf bag and clubs includes an integrated suitcase portion with one or more compartments for packing articles of clothing therein. In a preferred embodiment, the suitcase portion is in the form of a garment bag that releasably attaches to an inside back panel of the travel cover. The garment bag can be removed from the travel cover for separate transport and use. In another embodiment, the suitcase portion is fabricated within the travel cover and includes a top panel which secures closed to separate the clothing compartments of the suitcase portion from the golf bag holding compartment. In still another embodiment, the suitcase portion is provided on the exterior top side of the travel cover and includes an independently secured cover panel which opens to permit access to the clothing compartments. In yet a further embodiment, the suitcase portion is a garment bag that releasably attaches to the exterior of the travel cover and is separable therefrom.

9 Claims, 6 Drawing Sheets

COMBINATION GOLF BAG TRAVEL COVER AND SUITCASE

This Application is based on Provisional Patent Application Ser. No. 60/508434 filed on Oct. 3, 2003.

BACKGROUND OF THE INVENTION

1. Field of the Invention

The present invention relates to luggage and, more particularly, to a combined golf bag travel cover and suitcase which allows a golfer to pack a set of golf clubs and golf bag along with the golfer's clothing and other belongings in a single article of luggage when traveling to a golf destination.

2. Discussion of the Related Art

Travel covers or cases for protectively transporting golf bags and clubs are well known in the art. The travel case, which is sized and structured to hold a set of golf clubs and golf bag within an interior compartment, are available in both a hard style case and a soft style case which is also referred to as a cover. The hard style case is typically molded from a rigid and durable plastic composition and typically has two halves which hinge closed to protectively contain the golf bag and clubs therein. Soft style travel covers are similar in nature to a large duffel bag and are normally fabricated of durable woven materials, such as ballistic nylon.

In order to avoid having to carry a separate suitcase, many golfers attempt to pack their clothing and other belongings in the golf bag travel cover, within the same compartment as the golf bag and/or small pockets provided on the travel cover. Unfortunately, most golf bag travel covers fail to provide adequate space for packing clothing and other articles in addition to the golf bag and clubs. Moreover, the pockets on golf bag travel covers are relatively small and not suited for holding more than a few items. Nonetheless, many golfers who are desperate to avoid having to carry a separate suitcase will stuff their clothing around the sides of the golf bag within the travel cover and in any small pockets that might be available. Unfortunately, when the golfer reaches his/her destination, they realize that this method of packing is not an adequate and convenient solution. Because presently available golf travel bags are not intended to function as a suitcase, clothing articles which are stuffed in the limited available space become excessively wrinkled when removed. Also, the small amount of space which remains after the golf bag is placed within the travel cover significantly limits the amount of clothing which can be stuffed around the golf bag. A further inconvenience is the need for the golfer to take his/her bag up to the hotel room to unpack the clothing from the travel cover and golf bag instead of just sending the golf bag directly to the golf course upon arrival at the hotel.

In view of the shortcomings associated with the numerous golf bag travel covers and cases presently available on the market, there remains an urgent need for a golf bag travel case having an integrated suitcase to allow a golfer to neatly pack all of his/her clothing and other belongings and golf clubs in the same article of luggage, thereby avoiding the need to carry a separate suitcase.

SUMMARY OF THE INVENTION

The present invention is directed to a travel case for transporting a golf bag and clubs. The golf bag travel case of the present invention provides an integrated suitcase portion with one or more compartments. The compartments of the suitcase portion are specifically structured, sized and arranged for neatly packing folded articles of clothing in a manner which prevents excessive wrinkling. The compartments of the suitcase portion also accommodate one or more pairs of shoes, toiletries and other personal belongings which are ordinarily packed along with one's clothing in a suitcase.

In a preferred embodiment of the invention, the suitcase portion releasably attaches to the travel case and is separable therefrom. More particularly, the suitcase portion releasably attaches to an interior structure of the travel cover, preferably on the inside back panel behind the golf bag, and is removable therefrom for independent transport and use. Alternatively, the suitcase portion may releasably attach to the top panel of the golf bag travel cover with the use of one or more zippers and/or snaps. In either example, the suitcase portion, when removed from the golf bag travel cover, resembles a garment bag and is adapted to fold in half for easy carrying and stowage. In this particular embodiment, the suitcase portion may be specifically structured to carry articles of clothing on hangers, such as sport coats, dress slacks and shirts and can be conveniently hung in a closet (e.g. a hotel room) to allow access to one's clothing when the travel cover and golf bag are stored at a separate location (e.g. club-house).

In another embodiment of the invention, the suitcase portion is fabricated within the interior of the golf bag travel cover and includes a top panel which is secured closed, with zippers, snaps, hook and loop fasteners or other well known releasable securing means. The top panel of the suitcase portion separates the clothing compartments from the golf bag holding compartment.

In yet another embodiment of the invention, the suitcase portion is provided on the exterior of the golf bag travel cover. More specifically, the suitcase portion is integrated with the top panel of the golf bag travel cover and zips open to permit placement and removal of the golf bag and clubs within the cover. The suitcase portion, on the top panel of the golf bag travel cover, includes an independently secured cover panel which opens to permit access to the clothing compartments therein. Again, the cover panel is secured closed with the use of zippers, snaps, hook and loop fasteners or other well known releasable securing means.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENTS

Figure 1:
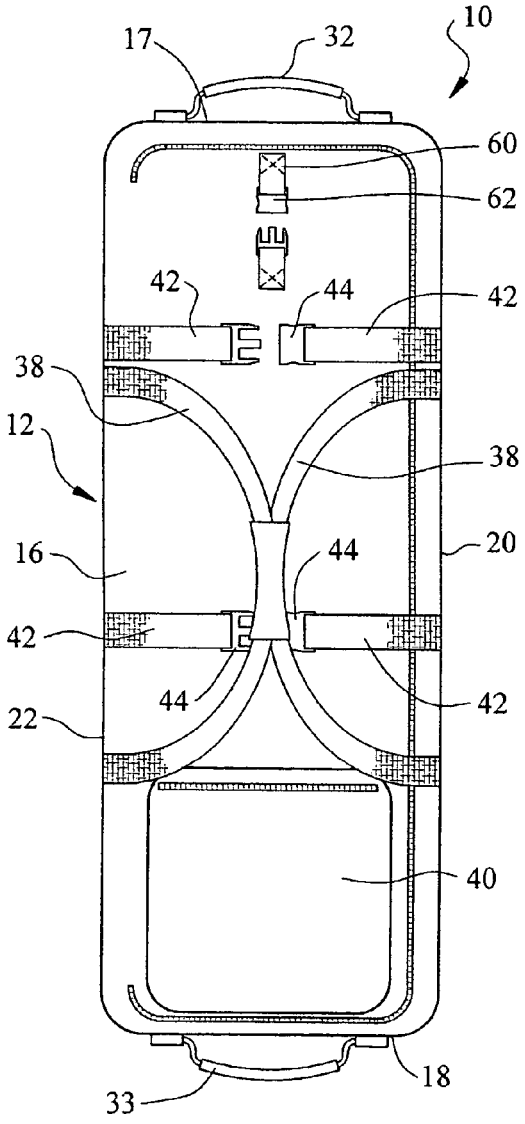
FIG. 1 is a top plan view of the golf bag travel cover in accordance with a preferred embodiment of the present invention.

The travel cover of the present invention is shown and described according to several embodiments, which are generally indicated by reference numerals 10, 10A–10C. In each of the several embodiments shown throughout the drawing figures, the travel cover is formed of a fabric material, preferably a durable woven fabric, such as ballistic nylon. The fabric case 12 of the travel cover includes a bottom side 14, a top side 16, an upper end 17, and a lower end 18, as well as opposite side walls 20, 22. A zipper opening 24 on the top side 16 permits access to an interior storage compartment 48 that is sized and configured for placement of a golf bag G (including clubs) therein. The various embodiments of the travel cover also have an upper handle 32, a lower handle 33, wheels 34 and side strap handles 38 for carrying the travel cover in a manner similar to a duffel bag. Rubber rib members 36 on the bottom side 14 support the bottom side 14 of the fabric casing above the ground, thereby protecting the fabric casing on the bottom side 14 from exposure to moisture and damage. The top side 16 of the travel cover may further include a zipper compartment 40 for the storage of shoes S or other items therein. The ribs 36 further prevent excessive wear of the travel cover 10A, such as often occurs when luggage is moved through the baggage handling process of a commercial airline.

An important feature of each of the several embodiments of the travel cover is the provision of an integrated suitcase portion 50 for the placement of articles of clothing and other personal belongings therein when traveling to a golf destination. In some of the embodiments, the suitcase portion 50 is incorporated within the inside of the travel cover, adjacent the golf bag compartment 48. The suitcase portion 50 has a flexible fabric shell 52 which may be a durable woven fabric much like the travel cover or, alternatively, a lightweight fabric similar to lining in a conventional suitcase. Zippers 56 on the top side 54 of the suitcase portion 50 open to allow the top side 54 to be folded over to the side, thereby permitting access to the interior. The interior of the suitcase portion 50, being divided into one or more compartments, is specifically sized to hold neatly folded articles of clothing C in a manner which prevents excessive wrinkling, similar to a conventional suitcase. Straps may be provided within the interior of the suitcase portion 50 to hold the folded articles of clothing C and other articles in place during travel. Additionally, straps 58 are provided to hold the golf bag G in place within the golf bag compartment 48 during transport.

Figure 2:
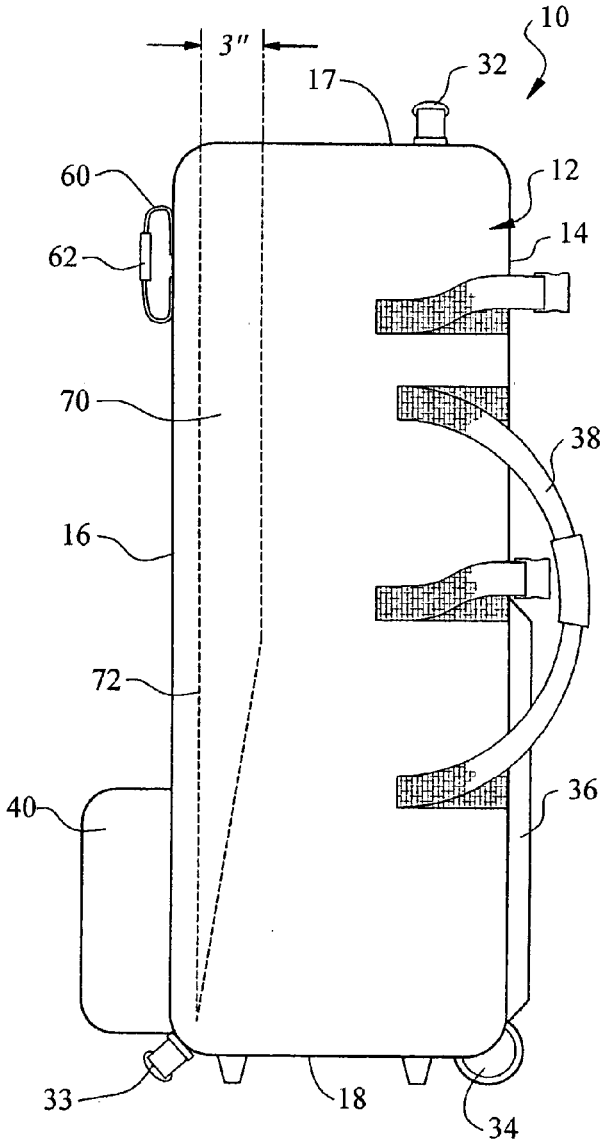
FIG. 2 is a side elevational view of the golf bag travel cover of FIG. 1.
Figure 3:
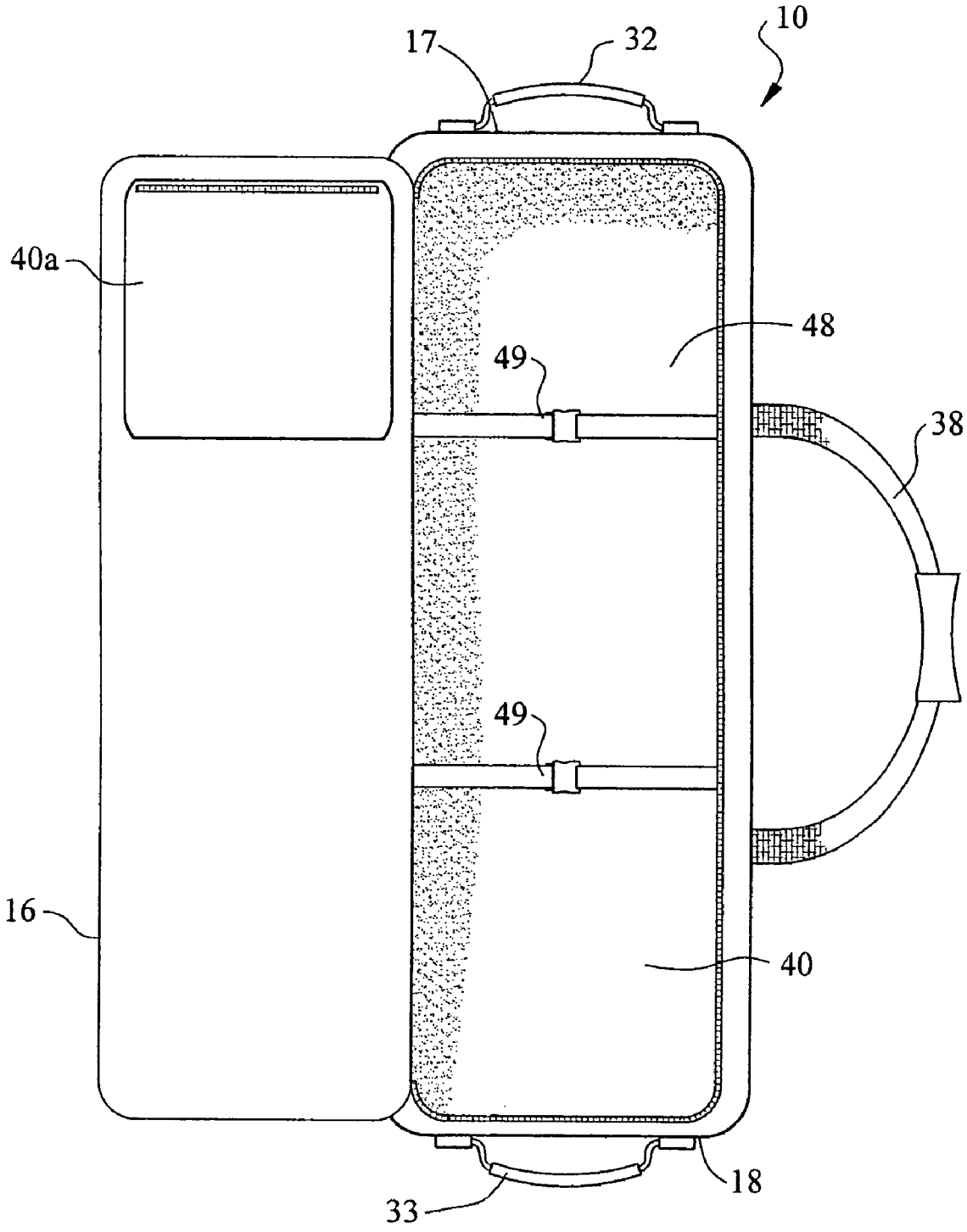
FIG. 3 is a top plan view of the golf bag travel cover of FIG. 1 shown with the top panel zipped open to reveal an interior storage compartment for placement of a golf bag with clubs therein.

Referring to FIGS. 1–4 a preferred embodiment of the combination golf bag travel cover and suitcase is shown, wherein the travel cover is generally indicated as 10. In addition to the features described above, the travel cover 10 includes outer transverse securing straps 42 each having first and second strap segments which secure together with quick release buckles 44 to hold the soft, flexible material travel cover tight around the golf bag contained therein. The travel cover 10 zips open, about zipper opening 24, to allow the top side panel 16 to be flipped over to the side, as seen in FIG. 3, thereby allowing easy and full access to the interior storage compartment 48 so that the golf bag G can be easily placed and removed within the compartment 48. The zipper opening 24 also allows for full access to the removable garment bag 50 releasably secured to the inside back panel within the compartment 48. Securing straps 49 are provided within the interior compartment 48 for holding the golf bag G in secured position within the compartment 48. The same straps, or additional straps, may be provided to maintain the garment bag 50 in secured, fixed position against the inside back panel of the compartment 48. The straps 49 are preferably of a bright color so that they can be easily seen and identified within the compartment 48. The travel cover 10 further includes a second shoe compartment 40*a* on the inside of the top side panel 16. The second shoe compartment 40*a* may include a zipper opening, elastic opening or other similar closure means for securing at least one pair of shoes therein.

The travel cover 10 further includes a strap loop 60 which opens with a quick release buckle 62 for securing a briefcase or laptop case to the travel cover. Specifically, the strap loop 60 may be opened and secured about the handle of a brief case, laptop case, purse or like or other small carry bag.

As seen in FIG. 2, the sidewall structure of the travel case 10 is provided with an expansion zone 70 to increase the overall height of the travel cover, from the bottom side 14 to the top side 16, by approximately three inches. A zipper 72 extends about the side walls 20, 22 and the upper end 17. When the zipper is closed, the expansion zone 70 is eliminated, allowing the travel cover 10 to assume a smaller profile. When it is desired to expand the overall size of the travel cover 10, to increase the storage volume within the interior compartment 48, the zipper 72 is opened, allowing the expansion zone 70 to stretch and move the top side panel 16 away from the bottom side panel 14.

Figure 4:
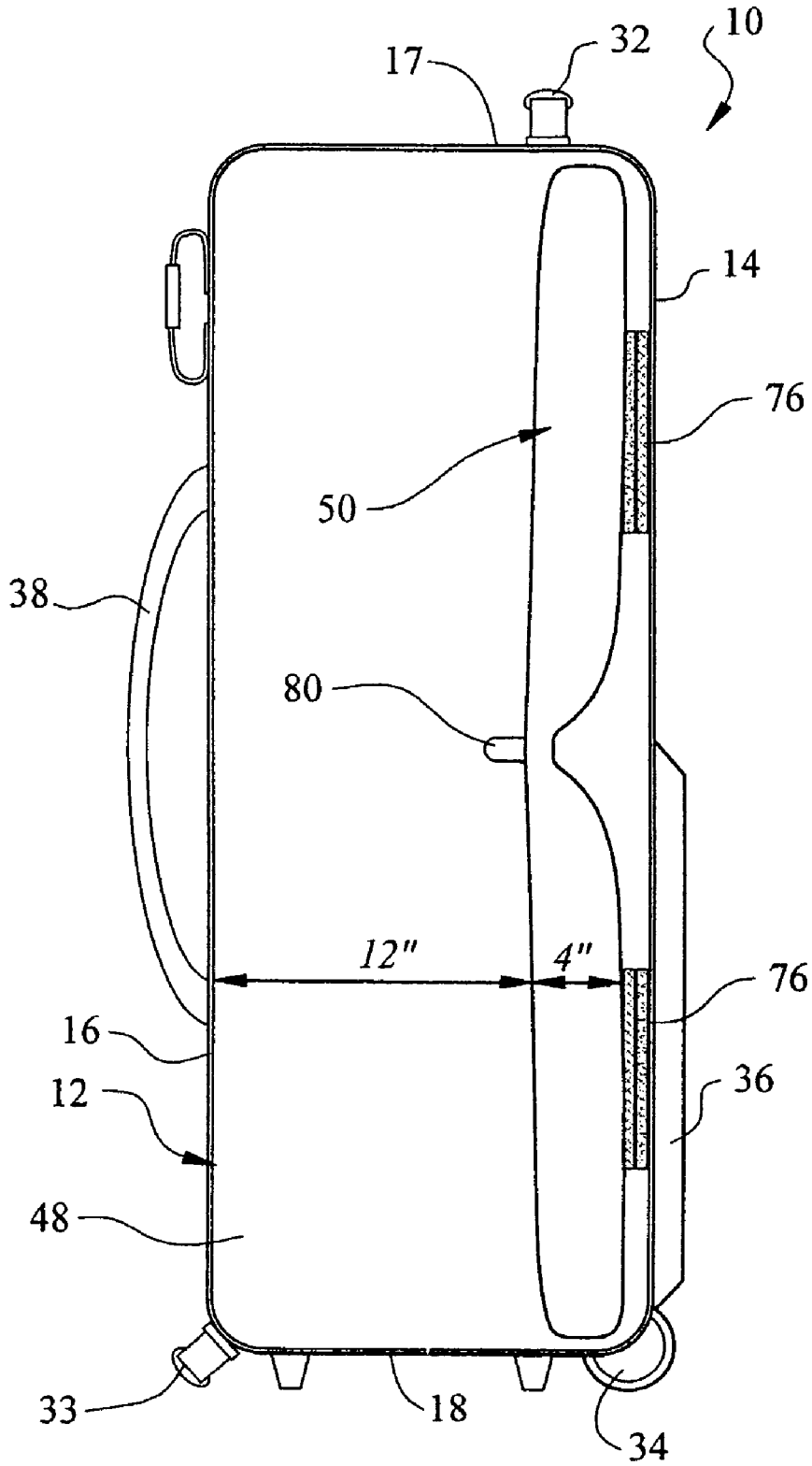
FIG. 4 is a side elevational view, in partial cross-section, showing the combination golf bag travel cover and suitcase according to the embodiment of FIG. 1, wherein the suitcase is in the form of a hanging garment bag which removably attaches to the inside back panel of the travel cover, within the interior compartment thereof.

Referring to FIG. 4, the garment bag 50 is releasably secured to the inside surface of the bottom side panel 14, within the storage compartment 48. The garment bag 50 may be releasably secured to the inside surface of the panel 14 with the use of cooperating hook and loop fasteners 76 provided on both the back side of the garment bag and the inside surface of the panel 14 within the storage compartment of the travel cover. Accordingly, the garment bag 50 can be easily separated from the inside surface of the panel 14 and removed from the storage compartment 48 for independent use. The handle 80 on the garment bag permits ease of carrying in a folded position, similar to that shown in connection with the embodiment of FIG. 9B.

Figure 5:
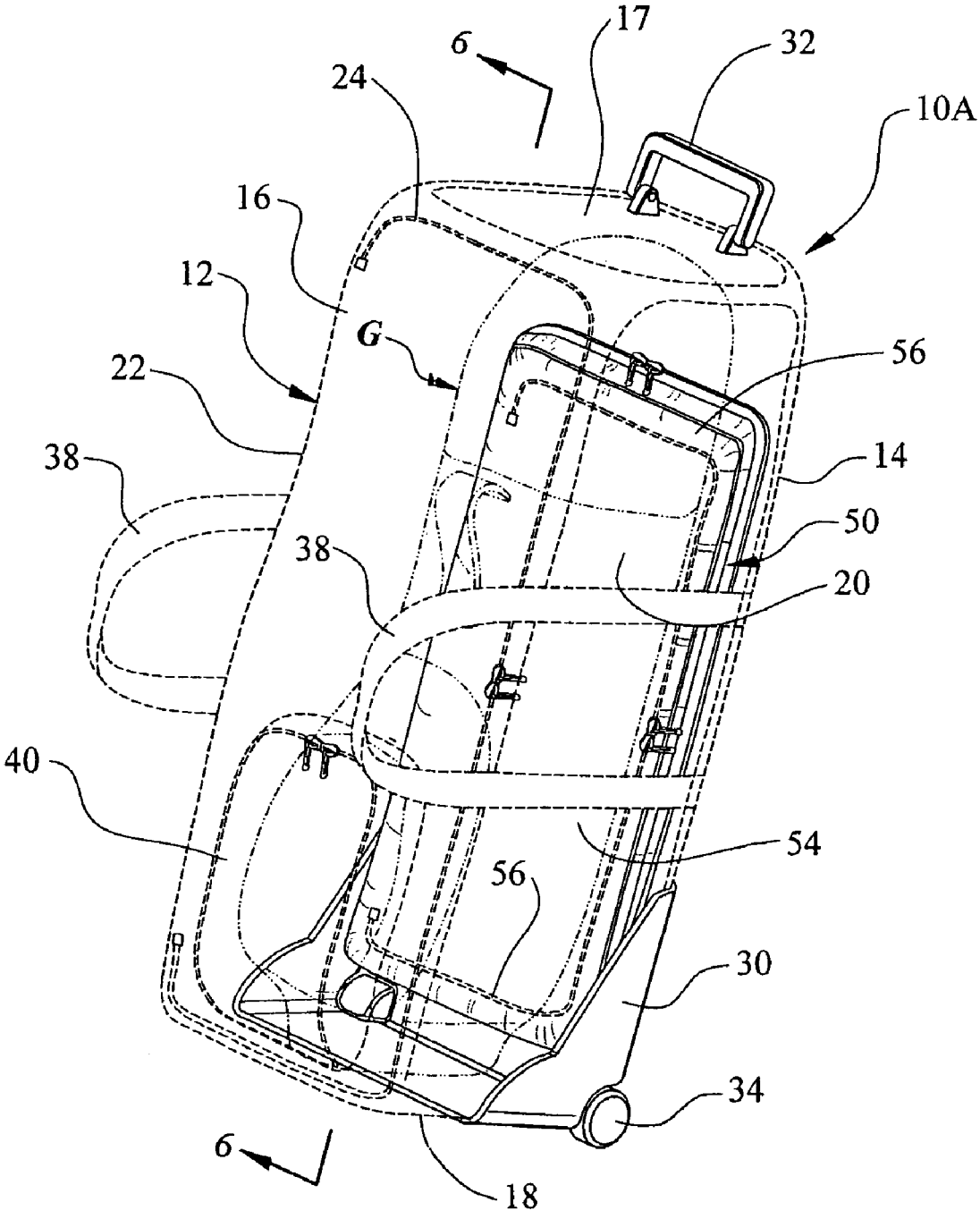
FIG. 5 is a front top perspective view of another embodiment of the combination golf bag travel cover and suitcase of the present invention, wherein the golf bag travel cover is constructed as a soft case with a partial rigid bottom and roller assembly and the suitcase for packing clothing and other personal effects is integrated within the interior of the travel cover.
Figure 6:
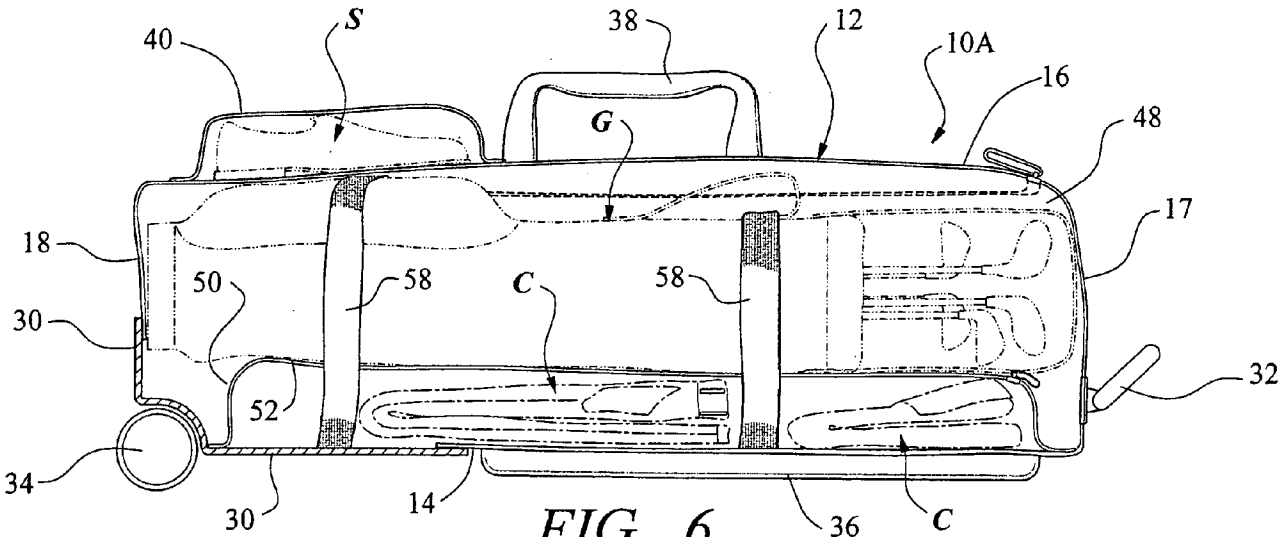
FIG. 6 is a cross-sectional view taken along the plane line indicated as 6—6 in FIG. 5.
Figure 7:
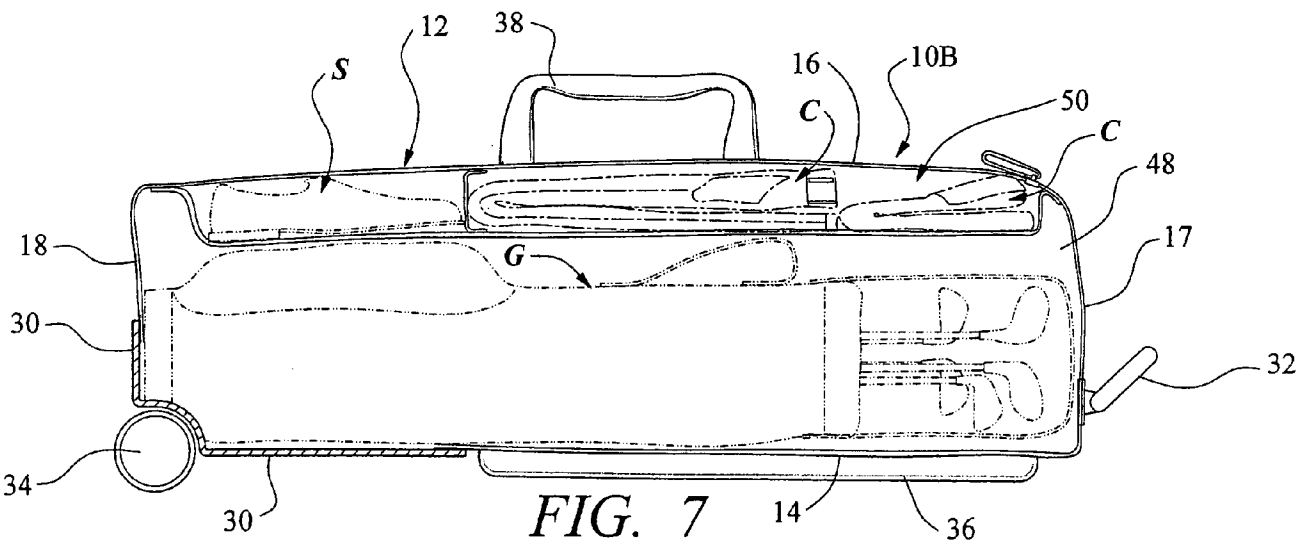
FIG. 7 is a cross-sectional view similar to that of FIG. 6 and illustrating an alternative embodiment wherein the suitcase portion is provided on the exterior of the golf bag holding compartment and integrated with the top cover panel.

Referring to FIGS. 5 and 6, another embodiment of the travel cover is shown and is generally indicated as 10A. In this particular embodiment, the travel cover 10A includes a rigid bottom support 30 extending partially along the lower end 18 and a portion of the bottom side 14 to provide strength and rigidity, particularly when pulling the travel cover along a ground surface and over curbs. The suitcase portion 50 is formed as an integrated component within the interior compartment 48 of the travel cover 10A. In this particular embodiment, the walls of the suitcase portion 50, separating the interior storage area of the suitcase portion from the storage compartment 48, are formed of a flexible, lightweight material, such as a nylon lining. A zipper opening 56 allows the suitcase portion 50 to be opened, providing full access to the interior of the suitcase portion 50 so that clothing articles C and other items may be conveniently packed therein.

Referring to FIGS. 7–9B, further embodiments of the travel cover are shown and are generally indicated as 10B and 10C. In each of these embodiments, the suitcase portion 50 is incorporated on the top side 16 of the travel cover, in exterior relation to the golf bag compartment 48. The travel case 10B shown in FIG. 5 provides for multiple compartments within the suitcase portion 50 for holding shoes or other articles in one compartment, and clothing C in one or more other compartments. In this particular embodiment, the suitcase portion 50 is fixed to the top side 16 of the travel cover and opens, with the top side of the travel cover, with the use of the zippers 24, as seen in connection with the embodiments of FIGS. 1 and 2, to provide access to the golf bag compartment 14 so that the golf bag and clubs can be placed and removed within the compartment 48.

Figure 8:
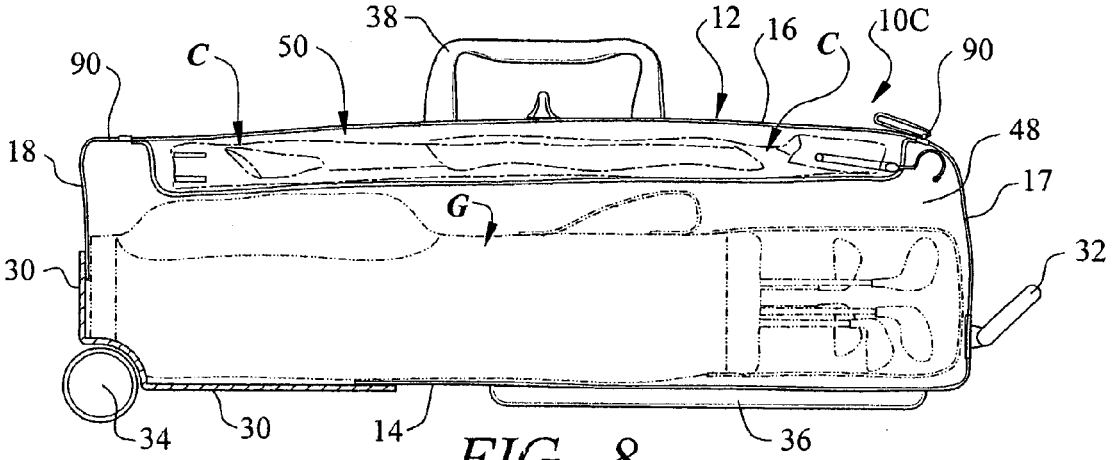
FIG. 8 is a cross-sectional view of yet a further embodiment of the invention, wherein the suitcase portion is removably attached to the top of the golf bag travel cover.
Figure 9B:
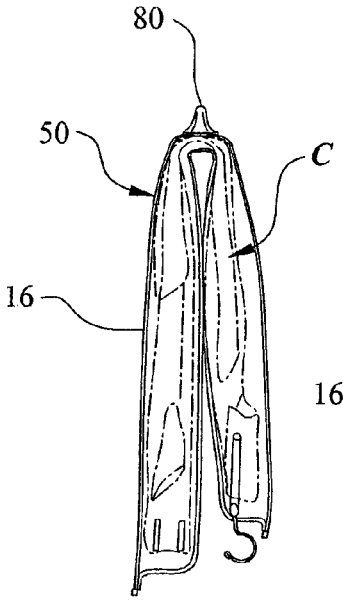
FIG. 9B is an isolated side elevational view showing the removed suitcase portion of the embodiment of FIG. 8 in a folded configuration for carrying independently of the golf bag travel cover.
Figure 9A:
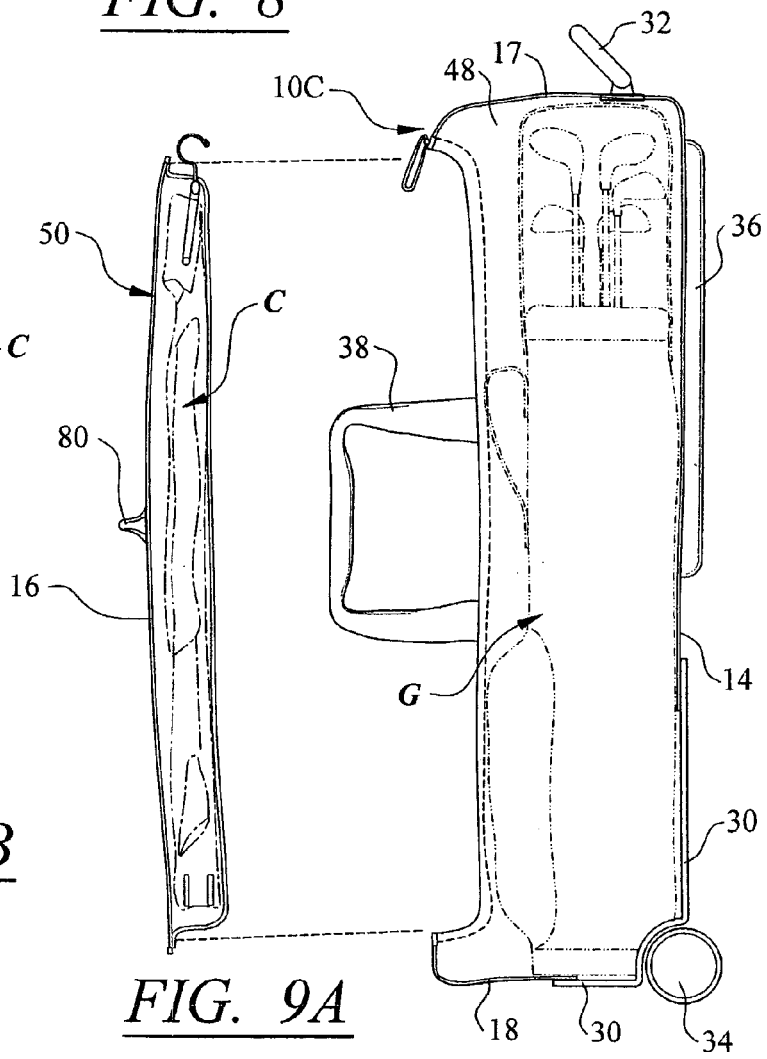
FIG. 9A is a partially exploded cross-sectional view of the embodiment of FIG. 8 showing the suitcase portion separated from the golf bag travel cover.

In the embodiment shown in FIGS. 8–9B, the suitcase portion 50 is removable from a remainder of the travel cover casing 12, thereby allowing the suitcase portion 50 to accompany the user to his/her hotel room while the travel cover 10, holding the golf bag and clubs G, is transported to the clubhouse or other storage location near the golf course. In this particular embodiment, the suitcase portion 50 may be structured to resemble a hanging garment bag which is adapted to hold a plurality of articles of clothing on hangers, and which further is adapted to be folded in half, as seen in FIG. 9B, for carrying with use of handle 80. The suitcase portion 50 in the embodiment of 10C separates from the remainder of the travel cover casing 12 with the use of a zipper 90 which extends about the entire outer periphery of the top side 16 defining the outer shell of the suitcase portion 50. An inner panel or cover may be provided to enclose the golf bag compartment 48 when the suitcase portion 50 is removed, thereby securely holding the golf bag G within the compartment 48 when the suitcase portion 50 is removed.

In each of the embodiments, as shown as described above, the suitcase portion 50 may be structured to have a single compartment or, alternatively, multiple divided compartments. The storage size of the suitcase portion, in each embodiment, is at least 18 inches in length, 14 inches in width, and 6 inches deep. In a preferred embodiment, the total length of the combined one or more storage compartments of the suitcase portion 50 is between 44 inches and 52 inches. The depth of the storage compartments in the suitcase portion 50 may range between 2 inches to 8 inches. The width of the storage compartments of the suitcase portion preferably ranges between 8 inches and 18 inches.

While the present invention has been shown and described in accordance with several preferred and practical embodiments thereof, it is recognized that departures from the instant disclosure are contemplated within the spirit and scope of the present invention.

What is claimed is:

1. A luggage article for transporting a golf bag with clubs and articles of clothing, comprising:

a golf bag travel cover having a plurality of main wall panels extending between an upper end wall and a lower end wall and surrounding an interior storage compartment, said main wall panels including a top wall panel, a bottom wall panel, a left side wall panel and a right side wall panel, and said travel cover further including a closeable access opening for permitting access to said interior storage compartment, and said interior storage compartment being sized and configured for holding the golf bag with clubs therein;

a releasable closure mechanism for securing said access opening of said travel cover closed with the golf bag and clubs placed within said interior storage compartment;

a garment bag including at least one interior clothing compartment sized and configured for packing the articles of clothing therein, and said garment bag being removably attachable to said travel cover within said interior storage compartment with said garment bag lying flat and unfolded along a single plane and against one of said plurality of wall panels of said travel cover, and said interior storage compartment of said travel cover being accessible to permit placement and removal of the golf bag with clubs therein while said garment bag remains securely attached to said travel cover, and said at least one clothing compartment being accessible to permit placement and removal of the articles of clothing therein while said garment bag remains securely attached to said travel cover;

at least one handle on said travel cover for carrying said travel cover and said garment bag as a combined unit, with the golf bag with clubs and articles of clothing contained therein; and at least one handle on said garment bag to facilitate carrying of said garment bag separately from said travel cover.

2. The luggage article as recited in claim 1 wherein said garment bag is sized, structured and configured for neatly packing folded articles of clothing and hanging articles of clothing therein.

3. The luggage article as recited in claim 1 wherein said garment bag is removably attachable to one of said plurality of main wall panels within said interior storage compartment.

4. The luggage article as recited in claim 1 wherein said access opening is formed in said top wall panel, and said access opening is structured and configured to allow said top wall panel to be folded open to one side, as a flap, thereby allowing for ease of placement and removal of the golf bag with clubs from within said interior storage compartment while also allowing access to the articles of clothing packed within said garment bag with said garment bag remaining securely attached to said travel cover.

5. The luggage as recited in claim 1 further including at least one securing strap within said interior storage compartment for securing the golf bag with clubs within said interior storage compartment, and wherein said at least one securing strap is structured to wrap around and tighten about the golf bag with the golf bag placed within said interior storage compartment.

6. A luggage article for transporting a golf bag with clubs and articles of clothing, comprising:

a golf bag travel cover having a plurality of main wall panels extending between an upper end wall and a lower end wall and surrounding an interior storage compartment, said main wall panels including a top wall panel, a bottom wall panel, a left side wall panel and a right side wall panel, and said travel cover further including a closeable access opening for permitting access to said interior storage compartment, and said interior storage compartment being sized and configured for holding the golf bag with clubs therein;

a releasable closure mechanism for securing said access opening of said travel cover closed with the golf bag and clubs placed within said interior storage compartment;

a garment bag including at least one interior clothing compartment sized and configured for packing the articles of clothing therein, and said garment bag being removably attachable to one of said plurality of main wall panels within said interior storage compartment with said garment bag lying flat and unfolded along a single plane and against said one of said plurality of wall panels of said travel cover, and said interior storage compartment of said travel cover being accessible to permit placement and removal of the golf bag with clubs therein while said garment bag remains securely attached to said travel cover, and said at least one clothing compartment being accessible to permit placement and removal of the articles of clothing therein while said garment bag remains securely attached to said travel cover, and said garment bag being removable from said interior storage compartment of said travel cover for separate and independent use;

at least one securing strap within said interior storage compartment for securing the golf bag with clubs within said interior storage compartment, and said securing strap being structured to wrap around and tighten about the golf bag with clubs when the golf bag with clubs is placed within said interior storage compartment;

at least one handle on said travel cover for carrying said travel cover and said garment bag as a combined unit, with the golf bag with clubs and articles of clothing contained therein; and at least one handle on said garment bag to facilitate carrying of said garment bag separately from said travel cover.

7. The luggage article as recited in claim 6 wherein said garment bag is sized, structured and configured for neatly packing folded articles of clothing and hanging articles of clothing therein.

8. The luggage article as recited in claim 6 wherein said garment bag removably attaches to said bottom wall panel within said interior storage compartment of said travel cover.

9. The luggage article as recited in claim 6 wherein said access opening of said travel cover is formed in said top wall panel, and said access opening being structured and configured to allow said top wall panel to be folded open to one said as a flap, thereby allowing for ease of placement and removal of the golf bag with clubs from within said interior storage compartment, and also allowing for access to said interior clothing compartment of said garment bag for placing and removing articles of clothing within said interior clothing compartment while said garment bag remains securely attached to said one of said plurality of main wall panels within said interior storage compartment of said travel cover.

* * * * *